US008106733B2

(12) United States Patent
Nakasuji et al.

(10) Patent No.: US 8,106,733 B2
(45) Date of Patent: Jan. 31, 2012

(54) SWITCH AND RECORDING MEDIUM

(75) Inventors: Masaki Nakasuji, Kanagawa (JP); Jun Sawai, Kanagawa (JP); Noboru Oya, Kanagawa (JP); Chiaki Ikeyama, Tokyo (JP); Tsutomu Shimosato, Tokyo (JP)

(73) Assignee: Sony Corporation, Tokyo (JP)

( * ) Notice: Subject to any disclaimer, the term of this patent is extended or adjusted under 35 U.S.C. 154(b) by 1231 days.

(21) Appl. No.: 11/673,167

(22) Filed: Feb. 9, 2007

(65) Prior Publication Data

US 2007/0188290 A1 Aug. 16, 2007

(30) Foreign Application Priority Data

Feb. 10, 2006 (JP) ..... 2006-034262

(51) Int. Cl.
*H01H 9/00* (2006.01)
*H05B 3/68* (2006.01)

(52) U.S. Cl. ..... 335/205; 219/457.1

(58) Field of Classification Search ..... 335/38, 335/205; 219/457.1
See application file for complete search history.

(56) References Cited

U.S. PATENT DOCUMENTS 3,711,672 A * 1/1973 Moreland et al. ..... 219/625
4,158,216 A * 6/1979 Bigelow ..... 200/600
5,592,079 A * 1/1997 Scheel ..... 324/207.25
5,920,131 A * 7/1999 Platt et al. ..... 307/104
6,188,332 B1 * 2/2001 Scarlata ..... 341/35
6,498,326 B1 * 12/2002 Knappe ..... 219/625
6,812,435 B2 * 11/2004 Schilling ..... 219/457.1
6,838,785 B2 * 1/2005 Schilling ..... 307/104
2003/0224737 A1 * 12/2003 Yokoji et al. ..... 455/90.3

FOREIGN PATENT DOCUMENTS

| | | |
|---|---|---|
| JP | 53-12089 | 2/1978 |
| JP | 58-80229 | 5/1983 |
| JP | 59-105225 | 6/1984 |
| JP | 60-7124 | 1/1985 |
| JP | 63-171930 | 7/1988 |
| JP | 83-171930 | 7/1988 |
| JP | 3-71769 | 7/1991 |
| JP | 7-26986 | 5/1995 |
| JP | 2000-100107 | 4/2000 |
| JP | 2003-216912 | 7/2003 |
| JP | 2003-257713 | 9/2003 |
| JP | 2004-355398 | 12/2004 |
| JP | 2005-228632 | 8/2005 |

* cited by examiner

*Primary Examiner* — Elvin G Enad
*Assistant Examiner* — Alexander Talpalatskiy
(74) *Attorney, Agent, or Firm* — Oblon, Spivak, McClelland, Maier & Neustadt, L.L.P.

(57) ABSTRACT

A switch has a detection portion that contains a magnetic-field-sensing element and an attraction member. The attraction member generates a magnetically attracting force. The detection portion generates a switching signal based on an output of the magnetic-field-sensing element.

3 Claims, 7 Drawing Sheets

FIG. 5
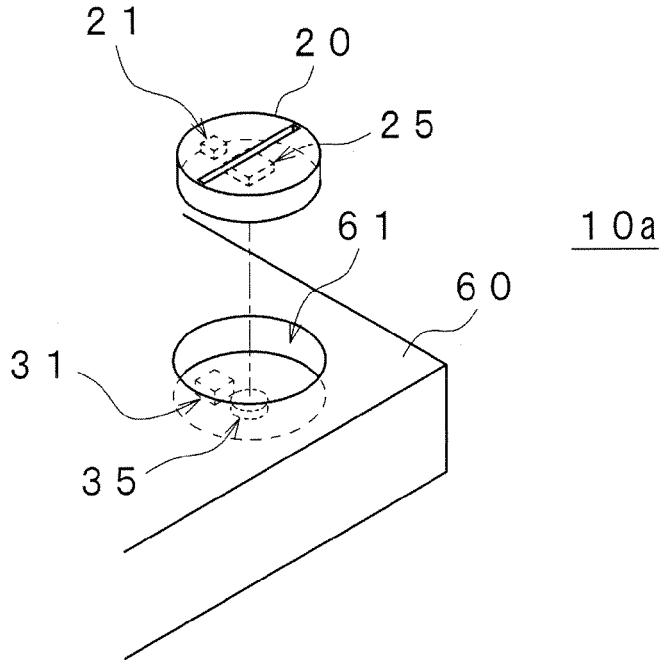
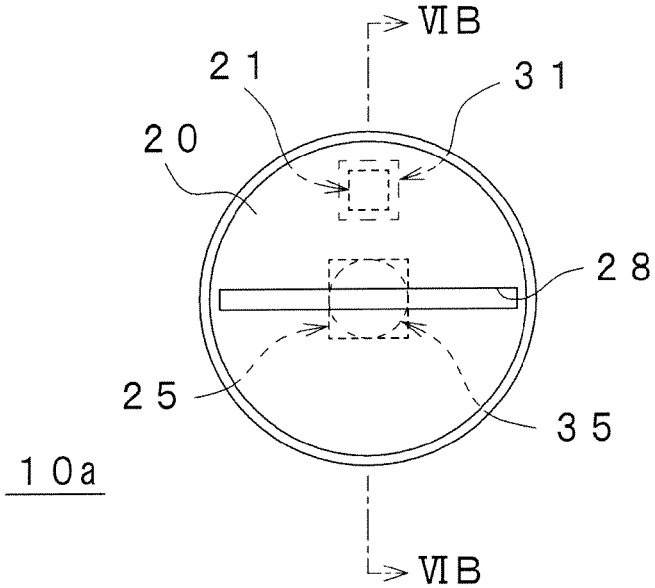
FIG. 6A
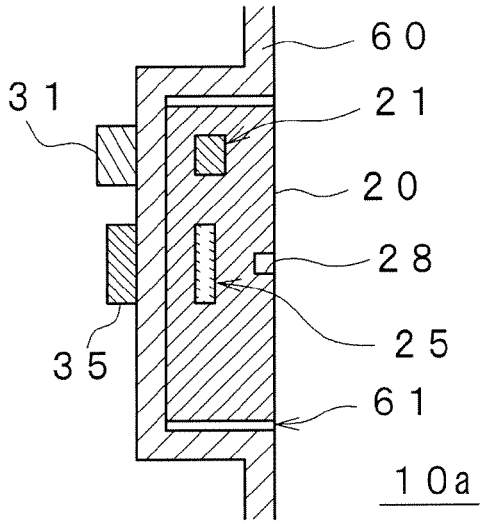
FIG. 6B

SWITCH AND RECORDING MEDIUM

CROSSREFERENCE TO RELATED APPLICATION

The present invention contains subject matters related to Japanese Patent Application JP 2006-034262 filed in the Japanese Patent Office on Feb. 10, 2006, the entire contents of which being incorporated herein by reference.

BACKGROUND OF THE INVENTION

1. Field of the Invention

The present invention relates to a switch and a recording medium such as an integrated circuit (IC) card using the same.

2. Description of Related Art

A switch 100, shown in FIG. 1, that is used in electronic equipment or the like has switched an electric circuit on or off by moving a movable contact 111 provided in an operation portion 110 of the switch 100 backwards and forwards or stirring it based on any switching operations by a user to establish contact or non-contact condition of the movable contact 111 with a fixed contact 121 of a detection portion 120 of the switch 100.

In a switch wherein the movable contact 111 has been switched so as to be in contact or non-contact with the fixed contact 121, if any failure in contact occurs by wear and/or corrosion on the movable contact 111 and the fixed contact 121, it may be difficult to switch the electric circuit on or off.

Accordingly, a contactless switch has been developed such that a magnet 112 and a magnetic-field-sensing element (for example, Hall element) 122 are used, as shown in FIG. 2, in place of the movable contact and the fixed contact. Such the contactless switch has recognized any switching operations by moving the magnet 112 backwards and forwards or stirring it based on any switching operations by a user so that the magnetic-field-sensing element 122 can detect any alteration in magnetic field generated when the magnet 112 moves. For example, Japanese Patent Application Publication No. S58-80229 has disclosed such a contactless switch. In this contactless switch, a magnet member is attached to an outer surface of a sliding rod that is jointed to a lever and a Hall integrated circuit detects any alteration in magnetic field generated when the magnet member moves based on any lever operations by the user so that the contactless switch can switch an electric circuit on or off.

SUMMARY OF THE INVENTION

A portable recording medium that is able to read or write data includes a recording medium of contact type, which has a contact, such as a memory card and a recording medium of non-contact type, which has no contact, such as an IC card. This recording medium of non-contact type may be mainly used for electronic payment or the like depended on transfer rate affair or storage capacity affair. Such the recording medium of non-contact type has no switch having any function (so-called write-protection switch) to forbid data from being written thereinto in order to protect stored data as the recording medium of contact type.

If, however, the recording medium of non-contact type may have a large storage capacity and transfer the data at a high transfer rate based on a tendency for low prices to any storage elements and/or downsizing thereof, the recording medium of non-contact type can be utilized as a versatile recording medium. In this moment, in the recording medium of non-contact type, it may be necessary to have any switch having a function to forbid the data from being written thereinto in order to protect the stored data as the recording medium of contact type.

Further, the recording medium of non-contact type has no contact for reading or writing data so that it can be sealed. Accordingly, the recording medium of non-contact type can be used under such a poor condition that a cloud of dust blows up, under water or the like, thereby reducing any damage by static electricity or the like. When, however, the switches shown in FIGS. 1 and 2 are used as write-protection switch in the recording medium of non-contact type, it is difficult to seal such the recording medium of non-contact type perfectly because an operation portion and a detection portion are integrated in the switch.

It is desirable to provide a switch and a recording medium using the same that are applicable to equipment having any sealed structure.

According to an embodiment of the present invention, there is provided a switch having a detection portion that contains a magnetic-field-sensing element and an attraction member. The attraction member generates a magnetically attracting force. The detection portion generates a switching signal based on an output of the magnetic-field-sensing element.

According to another embodiment of the present invention, there is provided a recording medium having a casing, a signal-transmitting unit that transmits a signal in wireless communication, a data storage unit that stores data, a control unit that controls the data storage unit to read and write the data, which is transmitted from the signal-transmitting unit, from and into the data storage unit, and a switch including a detection portion that contains a magnetic-field-sensing element and an attraction member, which generates a magnetically attracting force. The signal-transmitting unit, the data storage unit, the control unit, and the switch are enclosed in the casing. The detection portion generates a switching signal based on an output of the magnetic-field-sensing element. The control unit controls the data storage unit to read and write the data from and into the data storage unit based on the switching signal generated in the detection portion.

According to further embodiment of the present invention, there is provided an operation device that operates with a switch including a detection portion that contains a magnetic-field-sensing element and a first attraction member. The first attraction member generates a magnetically attracting force between the operation device and the detection portion. The detection portion generates a switching signal based on an output of the magnetic-field-sensing element. The operation device has a magnet that acts as a second attraction member to attract the first attraction member.

According to an embodiment of the invention, an operation portion is separated from the detection portion as well as the operation portion has a magnet while the detection portion has the magnetic-field-sensing element. The detection portion also has the attraction member, which generates a magnetically attracting force between the detection portion and the operation portion. When the operation portion is operated with the operation portion being attracted by the attraction member to the detection portion, a position of the magnet alters against the magnetic-field-sensing element in response to the operation which is applied to the operation portion so that the detection portion can generate the switching signal based on the output of the magnetic-field-sensing element in response to an operation which is applied to the operation portion.

Thus, even when the detection portion is enclosed in a perfectly sealed casing and the operation portion is provided out of the sealed casing, the detection portion can generate the switching signal in response to an operation which is applied to the operation portion, thereby enabling the switching operation to be attained under a poor condition that a cloud of dust blows up, under water or the like. The switch, the recording medium, and the operation device according to the above embodiments of the invention have not any mechanical driving parts and contacts so that a maintenance-free switch having a considerable long life cycle can be provided. Such the switch and the like have simple configurations so that their downsizing can be easily implemented. For example, the switch can be installed into any recording medium of non-contact type such as a card typed one or a thin type one so that operation modes in the recording medium can be set in response to an operation which is applied to the operation portion.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

BRIEF DESCRIPTION OF THE DRAWINGS

FIG. 5 is an exploded perspective view of a contactless switch for illustrating its configuration;

FIG. 6A is a diagram for showing a configuration of the contactless switch according to the embodiment of the invention and FIG. 6B is a sectional outline view thereof taken long the lines VIB-VIB shown in FIG. 6A;

DESCRIPTION OF THE PREFERRED EMBODIMENTS

Figure 1:
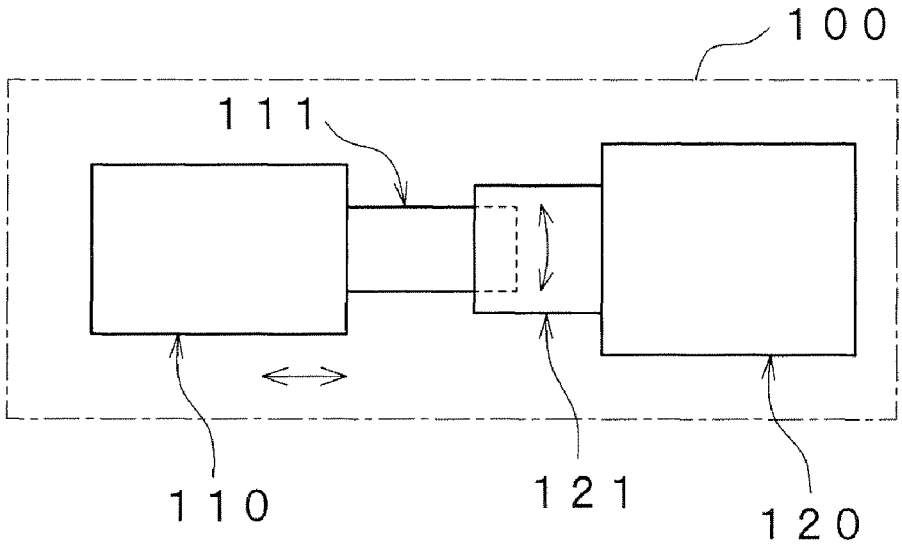
FIG. 1 (RELATED ART)
FIG. 1 is a diagram for showing a configuration of a switch according to a related art.
Figure 2:
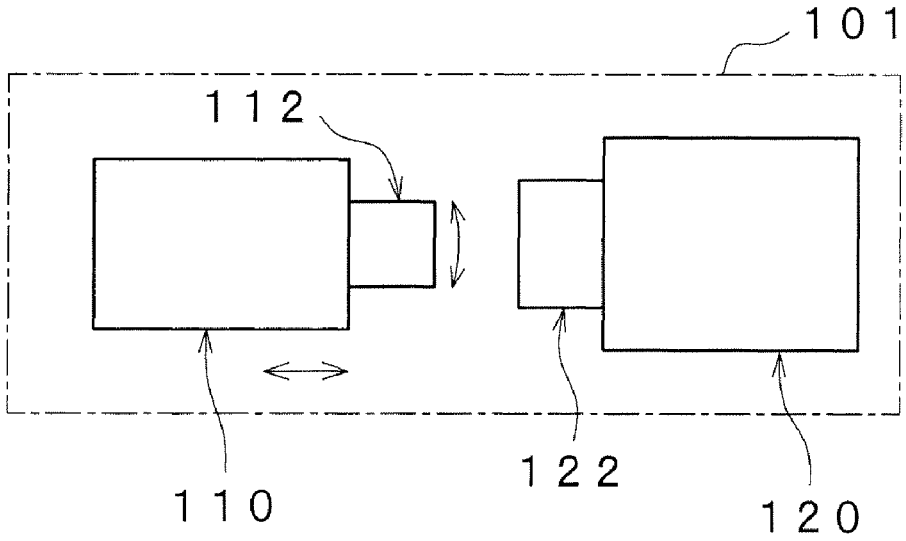
FIG. 2 (RELATED ART)
FIG. 2 is a diagram for showing a configuration of a contactless switch according to a related art.
Figure 3:
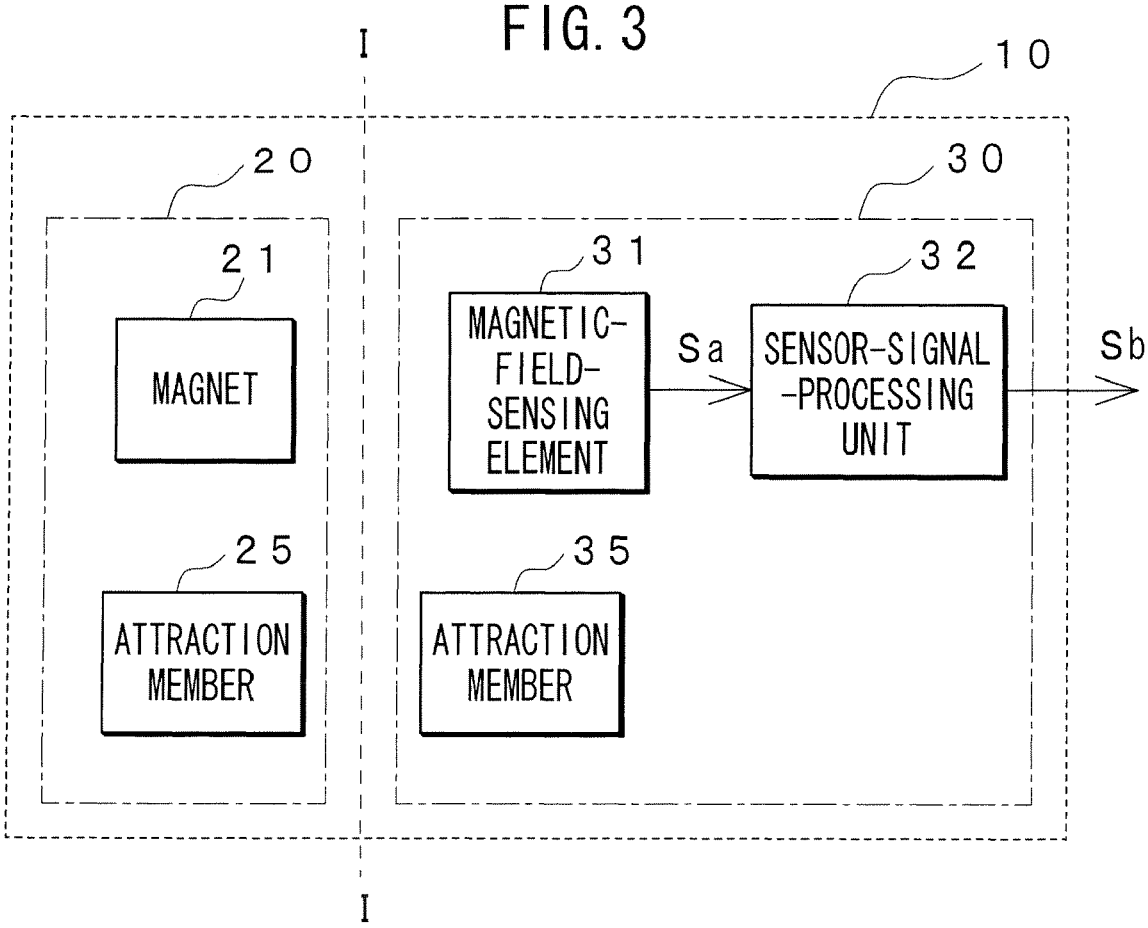
FIG. 3 is a diagram for showing a basic configuration of a contactless switch according to an embodiment of the invention.

The following will describe embodiments of the present invention with reference to the accompanied drawings. FIG. 3 shows a basic configuration of an embodiment of a contactless switch 10 according to the invention. The contactless switch 10 has an operation portion 20 that a user operates and a detection portion 30 that detects an operation by the user, which is applied to the operation portion 20. The operation portion 20 and the detection portion 30 may be physically separated from each other in the contactless switch 10 at a position thereof along lines I-I shown in FIG. 3. When this contactless switch 10 is enclosed in any equipment having, for example, a sealed structure and is used for switching therefor, the operation portion 20 is provided out of the sealed equipment and the detection portion 30 is enclosed in the sealed equipment. The operation portion 20 contains a magnet 21 and the detection portion 30 contains a magnetic-field-sensing element 31. Thus, when the user operates the operation portion 20, a position of the magnet 21 alters against the magnetic-field-sensing element 31 in response to his or her operation which is applied to the operation portion 20. Such the alteration in the position of the magnet 21 by the user causes any magnetic field from the magnet 21 to alter. The detection portion 30 can detect such the alteration in the magnetic field by its magnetic-field-sensing element 31. A sensor-signal-processing unit 32 of the detection portion 30 receives a sensor signal Sa from the magnetic-field-sensing element 31 and processes it to generate a switching signal Sb in response to an operation by the user which is applied to the operation portion 20.

Since the operation portion 20 and the detection portion 30 are physically separated from each other, the operation portion 20 can contain an attraction member 25 and the detection portion 30 can contain an attraction member 35. In this moment, any attracting force occurs between the operation portion 20 provided out of the sealed equipment and the detection portion 30 enclosed in the sealed equipment, thereby enabling the operation portion 20 to be held to the equipment without detaching it easily.

Figure 4:
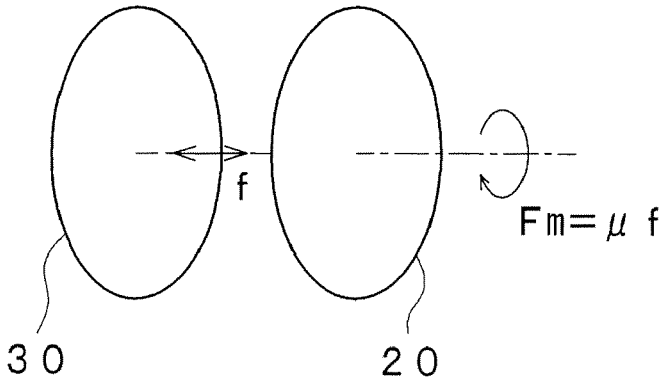
FIG. 4 is a diagram for explaining maintenance of the operation portion by a magnetic attraction.

Such the attraction between the operation portion 20 and the detection portion 30 may be easily and simply attained by using any magnetism. For example, as shown in FIG. 4, the operation portion 20 is formed as a disk and a magnet is set in any one of the operation and detection portions and a ferromagnet or a magnet is set in the other to configure the attraction members 25, 35 so that a magnetically attracting force "f" can occur between the operation portion 20 and the detection portion 30. In this case, when a center of action by the magnetism is set to a revolution axis of the operation portion 20, the operation portion 20 can rotate on the center of action by the magnetism as its revolution axis with the operation portion being attracted without taking into consideration any torsion thereby. Force Fm that may be necessary when the operation portion 20 rotates is calculated by multiplying the attracting force "f" by a coefficient of friction μ between the operation portion 20 and a casing of the equipment. Thus, if any fixed force more than the force Fm is applied thereto when the operation portion 20 rotates to switch the contactless switch 10 on or off, the operation portion 20 can rotate with the operation portion 20 and the detection portion 30 being physically separated from each other perfectly. It is noted that the attraction member 25, 35 may be respectively built in or out of the operation portion 20 and the detection portion 30. Further, when the detection portion 30 is fixed on the casing of the equipment, the attraction members are respectively provided to the operation portion 20 and the casing side thereof so that the operation portion 20 can be attracted to a side of the detection portion 30.

FIGS. 5, 6A and 6B show a configuration of the contactless switch 10*a*. FIG. 5 is an exploded perspective view thereof;

FIG. 6A is a front view thereof; and FIG. 6B is a sectional outline view thereof taken long the lines VIB-VIB shown in FIG. 6A.

The operation portion 20 of the contactless switch 10*a* is made of non-magnetic material such as plastic resin and molded as a disk so that the operation portion 20 can enclose the magnet 21 and the attraction member (for example, a ferromagnet) 25. The magnet 21 is used for detecting an operation position of the contactless switch and is provided near a peripheral edge thereof. The attraction member (for example, the ferromagnet) 25 allows the operation portion 20 to be attracted to the detection portion 30, thereby preventing the operation portion 20 from being detached from the equipment. Accordingly, the attraction member 25 is provided at a center of the operation portion 20. It is to be noted that the operation portion 20 has a slit 28 that is available for recognizing a rotation position of the operation portion 20 or rotating it.

The casing 60 of the equipment has a round recess portion 61 that has a diameter slightly larger than that of the disk-like operation portion 20. The operation portion 20 is inserted into the round recess portion 61. The attraction member (for example, a magnet) 35 is provided at a center position of the round recess portion 61 and inside the casing 60 so that any attracting force occurred between the attraction member (for example, the ferromagnet) 25 and the attraction member (for example, the magnet) 35 can prevent the operation portion 20 from being detached from the round recess portion 61. The magnetic-field-sensing element 31 for sensing magnetic field such as Hall element, magnetic resistance effect element or the like is provided inside the casing 60 at a position that is opposite a track occurred by a rotation of the magnet 21 accompanying the rotation of the operation portion 20 inserted into the round recess portion 61.

When the operation portion 20 of the contactless switch 10*a* thus configured rotates, a position of the magnet 21 against the magnetic-field-sensing element 31 alters in response to an operation which is applied to the operation portion 20. If the magnet 21 faces the magnetic-field-sensing element 31, a magnetic field applied to the magnetic-field-sensing element 31 is made largest. If the user operates the operation portion 20 to turn the magnet 21 apart from the magnetic-field-sensing element 31, a magnetic field applied to the magnetic-field-sensing element 31 is made smaller. The alteration in a position of the magnet 21 against the magnetic-field-sensing element 31 in response to an operation by the user which is applied to the operation portion 20 enables the magnetic field applied to the magnetic-field-sensing element 31 to alter, thereby allowing a level of the sensor signal Sa output from the magnetic-field-sensing element 31 to be made correspond to a rotation position of the operation portion 20.

The sensor-signal-processing unit 32 shown in FIG. 3 receives the sensor signal Sa from the magnetic-field-sensing element 31 and amplifies it. The sensor-signal-processing unit 32 then compares it with a threshold value to convert it to its binary signal. This binary signal obtained in the sensor-signal-processing unit 32 relates to the rotation position of the operation portion 20 so that the binary signal can be used as the switching signal Sb.

Alternatively, if a switching element for switching an electric circuit on or off is provided at the sensor-signal-processing unit 32, this switching element is driven on the basis of the binary signal so that the electric circuit can be switched on or off based on a rotation position of the operation portion 20.

It is also to be noted that although the attracting force between the ferromagnet 25 installed in the operation portion 20 and the magnet 35 provided in the detection portion 30 inside the casing 60 has enabled the operation portion 20 to be held to prevent it from being detached as shown in the embodiment shown in FIGS. 5, 6A and 6B, this invention is not limited thereto. A magnet can be used as the attraction member 25 and a ferromagnet can be used as the attraction member 35 so that they enable the operation portion 20 to be held to prevent it from being detached. Further, in place of the ferromagnet, a magnet can be used therefor.

Such the contactless switch thus configured allows any equipment or an electric circuit provided inside the casing to be switched on or off by operating the rotation of the operation portion 20 provided out of the casing. This allows the contactless switch according to the embodiment to be applicable for any equipment having a perfectly sealed structure used under such a poor condition that a cloud of dust blows up, under water or the like. The contactless switch according to the embodiment has no contact, thereby avoiding any failure in a contact by wear and/or corrosion, any damage in an internal circuit by static electricity or the like. This also allows for a long life cycle of the switch, thereby attaining the maintenance-free contactless switch. Any mechanical driving system is not provided in order to allow the operation portion 20 to rotate in this embodiment, thereby allowing the contactless switch 10*a* to be simplified, downsized and manufactured at a low price. Thus, it is possible to install the contactless switch onto a recording medium of thin type such as a card typed one.

Figure 7A:
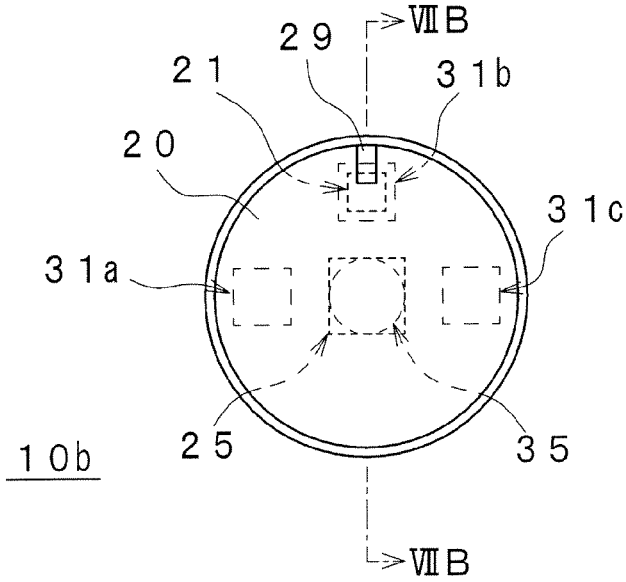
FIG. 7A is a diagram for showing a configuration of a contactless switch according to another embodiment of the invention and FIG. 7B is a sectional outline view thereof taken long the lines VIIB-VIIB shown in FIG. 7A.
Figure 7B:
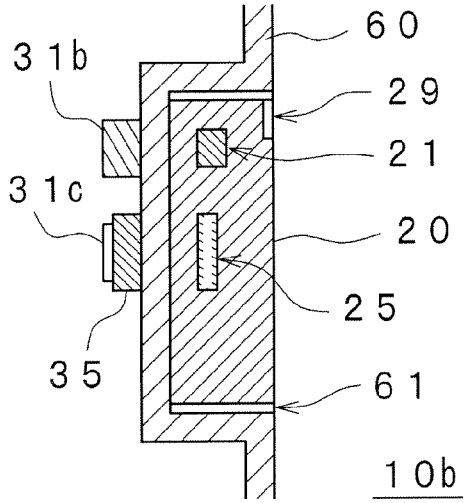

Although the contactless switch 10*a* shown in FIGS. 5, 6A and 6B has detected one switch position, according to another embodiment of the invention, a contactless switch in which plural magnetic-field-sensing elements are used can detect plural switch positions, thereby enabling such the multifunctional contactless switch to be implemented. FIGS. 7A and 7B show a configuration of a contactless switch 10*b* according to the above another embodiment of the invention in which three magnetic-field-sensing elements 31*a*, 31*b*, and 31*c* are used. FIG. 7A is a front view of the contactless switch 10*b*. FIG. 7B is a sectional outline view thereof taken long the lines VIIB-VIIB shown in FIG. 7A. In FIGS. 7A and 7B, like reference numbers refer to like elements of FIGS. 6A and 6B, a detailed explanation of which will be omitted.

The three magnetic-field-sensing elements 31*a*, 31*b*, and 31*c* are provided inside the casing 60 at positions that are opposite a track occurred by a rotation of the magnet 21 accompanying the rotation of the operation portion 20. The three magnetic-field-sensing elements 31*a*, 31*b*, and 31*c* respectively have different angles of predetermined amplitudes, for example, 90 degrees in an embodiment shown in FIGS. 7A and 7B around a center thereof as the revolution axis of the operation portion 20.

Such the contactless switch 10*b* in which the plural magnetic-field-sensing elements 31*a*, 31*b*, and 31*c* are used enables outputs from each of the magnetic-field-sensing elements 31*a*, 31*b*, and 31*c* to alter so that they have phase differences when the operation portion 20 rotates. If the operation portion 20 rotates to allow the magnet 21 to come most close to the magnetic-field-sensing element 31*a*, output from this magnetic-field-sensing element 31*a* is made largest. If the operation portion 20 further rotates to allow the magnet 21 to come most close to the magnetic-field-sensing element 31*b*, output from this magnetic-field-sensing element 31*b* is made largest. If the operation portion 20 additionally rotates to allow the magnet 21 to come most close to the magnetic-field-sensing element 31*c*, output from this magnetic-field-sensing element 31*c* is made largest.

Thus, based on the outputs from the magnetic-field-sensing elements 31*a*, 31*b*, and 31*c*, it is possible to determine which rotation position the operation portion 20 stays among the three rotation positions thereof. Accordingly, when a function is allocated to each of these three rotation positions, three functions can be switched when the operation portion 20 rotates. It is to be noted that an indicator 29 for indicating a rotation position of the operation portion 20 may be provided in the operation portion 20.

If one or more magnetic-field-sensing elements are provided when the sensor signal (s) Sa output from the magnetic-field-sensing element(s) is (are) converted to digital signal(s) thereof so as to be used as the switching signal(s) Sb, level(s) of the switching signal(s) alter(s) in response to an operation by the user which is applied to the operation portion 20, thereby implementing any multistage switching operations.

In the contactless switches according to the above embodiments, the attracting force between the attraction members 25 and 35 has held the operation portion 20 in order to prevent it from being detached from the round recess portion 61. If such the contactless switches are used in, for example, any portable equipment, the operation portion 20 may rotate too much by a vibration or the like when there is a less friction between a bottom surface of the round recess portion 61 and a bottom of the operation portion 20. Accordingly, a maintaining device may be provided for maintaining a rotation position of the operation portion 20 to prevent it from rotating too much by a vibration or the like. For example, such the maintaining device includes a projection and a recess in the bottom surface of the round recess portion 61 and the bottom of the operation portion 20 at a position thereof having a predetermined distance away from the revolution axis of the operation portion 20. In such the maintaining device, the projection and the recess can be engaged when the operation portion 20 reaches a desired rotation position. If the user rotates the operation portion 20 by excessive force more than predetermined force, they can be disengaged.

Thus, when the projection is provided in any one of the bottom surface of the round recess portion 61 and the bottom of the operation portion 20 and the recess is provided in the other, the magnetically attracting force allows the projection and the recess to be engaged to maintain the operation portion 20 at its desired rotation position when the operation portion 20 stays in the desired rotation position. When the user rotates the operation portion 20 by excessive force more than predetermined force, they are disengaged so that the rotation position of the operation portion 20 can be changed. In this moment, any magnetic attracting force is applied to the operation portion 20 and the detection portion 30, so that the operation portion 20 can be prevented from being detached from the casing 61 even if the rotation position of the operation portion 20 is changed.

If the operation portion 20 is set on the desired rotation position to be held on this position by utilizing any magnetic attracting force, it is possible to hold the operation portion 20 on the desired rotation position.

Figure 8A:
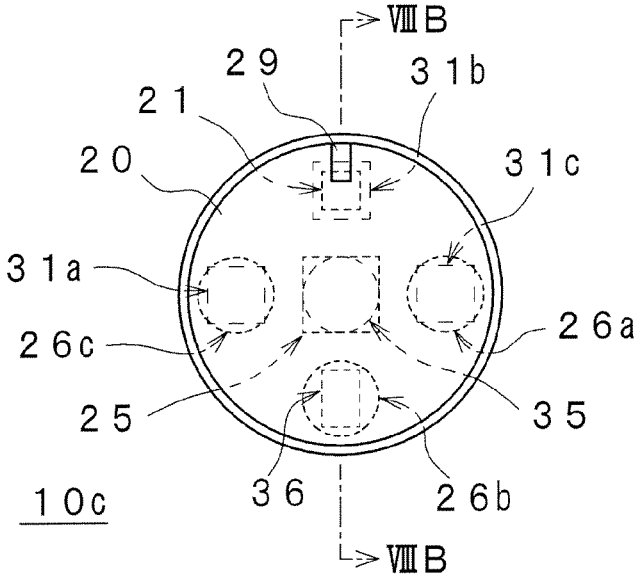
FIG. 8A is a diagram for showing a configuration of a contactless switch according to further embodiment of the invention and FIG. 8B is a sectional outline view thereof taken long the lines VIIIB-VIIIB shown in FIG. 8A.
Figure 8B:
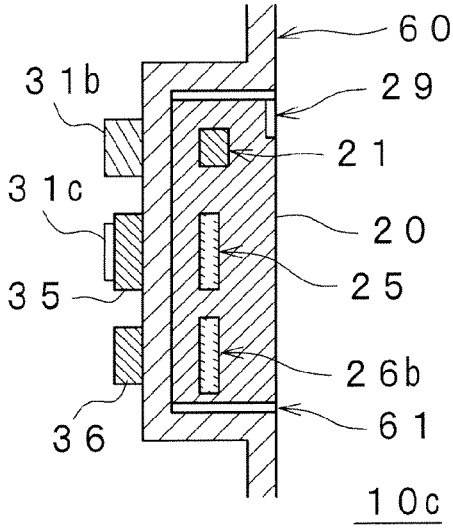

FIGS. 8A and 8B show a configuration of a contactless switch 10*c* according to further embodiment of the invention by which the rotation position of the operation portion 20 can be held by any magnetism. FIG. 8A is a front view of the contactless switch 10*c*. FIG. 8B is a sectional outline view thereof taken long the lines VIIIB-VIIIB shown in FIG. 8A. In FIGS. 8A and 8B, like reference numbers refer to like elements of FIGS. 7A and 7B, a detailed explanation of which will be omitted.

In this contactless switch 10*c*, if the magnetic-field-sensing elements 31*a*, 31*b*, and 31*c* are provided as shown in FIG. 7A, a magnet 36 for maintaining a rotation position of the operation portion 20 is provided at a position inside the casing 60, which has a difference in angle of 180 degrees with respect to the magnetic-field-sensing element 31*b*. Ferromagnets 26*a*, 26*b*, and 26*c* are provided in the operation portion 20 at positions that are capable of being faced with the magnet 36 when the operation portion 20 rotates to allow the magnet 21 to be faced with the magnetic-field-sensing elements 31*a*, 31*b*, and 31*c*.

Providing such the ferromagnets 26*a*, 26*b*, and 26*c* and the magnet 36 allows any magnetic attracting force to occur between the magnet 36 and any one of the ferromagnets 26*a*, 26*b*, and 26*c* when the operation portion 20 rotates to reach a rotation position where the magnet 36 faces any one of the ferromagnets 26*a*, 26*b*, and 26*c*. Such the magnetic attracting force prevents the operation portion 20 from being rotated from the casing 61 by a vibration or the like.

When the magnet 36 is set to have its polarity so that a magnetic field starting from the ferromagnets 26*a*, 26*b*, and 26*c* to the magnetic-field-sensing elements 31*a*, 31*b*, and 31*c* is applied to the opposite direction to that of a magnetic field starting from the magnet 21 to the magnetic-field-sensing elements 31*a*, 31*b*, and 31*c*, it is possible to determine the rotation position of the operation portion 20 properly based on the sensor signal Sa by using Hall element as the magnetic-field-sensing element because the direction of the magnetic field by each of the ferromagnets 26*a*, 26*b*, and 26*c* is opposite to that of the magnet 21 even if the ferromagnets 26*a*, 26*b*, and 26*c* are magnetized. It is to be noted that if Hall element is used as the magnetic-field-sensing element, a magnet can be used in place of each of the ferromagnets 26*a*, 26*b*, and 26*c*. In this moment, the polarity of the magnet is set so that a magnetic field, a direction of which is opposite to that of the magnetic field starting from the magnet 21 to the magnetic-field-sensing elements 31*a*, 31*b*, and 31*c*, can be applied thereto.

If the operation portion 20 has a small diameter and the round recess portion 61 is deep, any attracting force can occur between the side surfaces of the operation portion 20 and the round recess portion 61. This prevents the operation portion 20 from rotating by a vibration or the like.

Figure 9A:
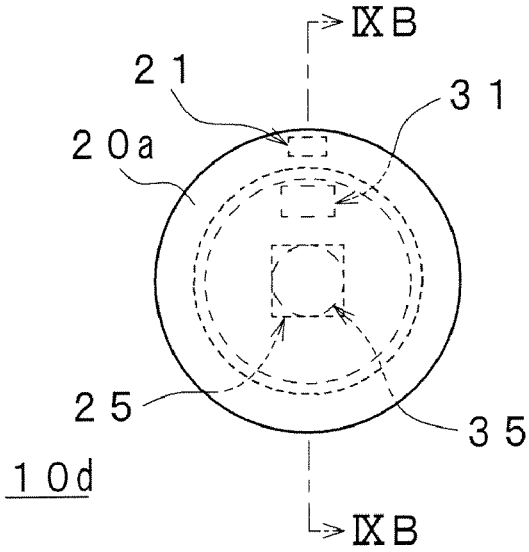
FIG. 9A is a diagram for showing a configuration of a contactless switch according to an additional embodiment of the invention and FIG. 9B is a sectional outline view thereof taken long the lines IXB-IXB shown in FIG. 9A.
Figure 9B:
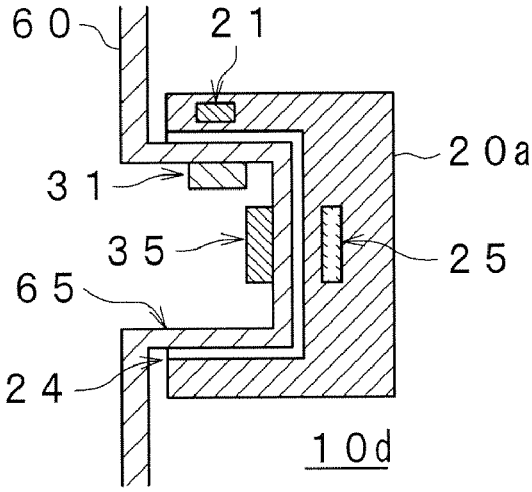

Although such the configuration that the operation portion 20 is inserted into the round recess portion 61 provided in the casing of the equipment has been described in the above embodiments, the invention is not limited thereto. An operation portion 20*a* can be provided so that it can be projected from the casing 60. FIGS. 9A and 9B show a configuration of a contactless switch 10*d* according to an additional embodiment of the invention in which the operation portion 20*a* can be projected from the casing 60. FIG. 9A is a front view of the contactless switch 10*d*. FIG. 9B is a sectional outline view thereof taken long the lines IXB-IXB shown in FIG. 9A. In FIGS. 9A and 9B, like reference numbers refer to like elements of FIGS. 7A and 7B, a detailed explanation of which will be omitted.

A projected rotation axis 65 is provided on the casing 60. A magnet 35 is provided on a back side of a forward end of the projected rotation axis 65. The operation portion 20*a* has at its back side an opening 24 having a slightly larger diameter than that of the projected rotation axis 65. The projected rotation axis 65 is inserted into the opening 24. A ferromagnet 25 is provided in the operation portion 25 at a bottom surface side of the operation portion 20*a* in the opening 24. Any attracting force occurred between the ferromagnet 25 and the magnet 35 prevents the operation portion 20*a* from being detached from the projected rotation axis 65. A magnet 21 is also provided in the operation portion 20*a* at a position in a circumferential side wall of the operation portion 20*a*. A magnetic-field-sensing element 31 is provided behind the projected rotation axis 65 at a position that is opposite a track occurred by a rotation of the magnet 21 accompanying the rotation of the operation portion 20*a* while the projected rotation axis 65 of the casing 60 is inserted into the opening 24 of the operation portion 20*a* and the ferromagnet 25 and the magnet 35 are attracted to each other.

When the operation portion 20*a* rotates in the contactless switch 10*d* thus configured, a rotation position of the magnet 21 can alter with respect to the magnetic-field-sensing element 31 in response to the operation by the user, which is applied to the operation portion. Such the alteration in the rotation position of the magnet 21 causes the magnetic field applied to the magnetic-field-sensing element 31 to alter. This enables a level of a sensor signal Sa output from the magnetic-field-sensing element 31 to be corresponded to the rotation position of the operation portion 20*a*. Accordingly, it is possible to determine the rotation position of the operation portion 20*a* properly based on the sensor signal Sa.

Figure 10A:
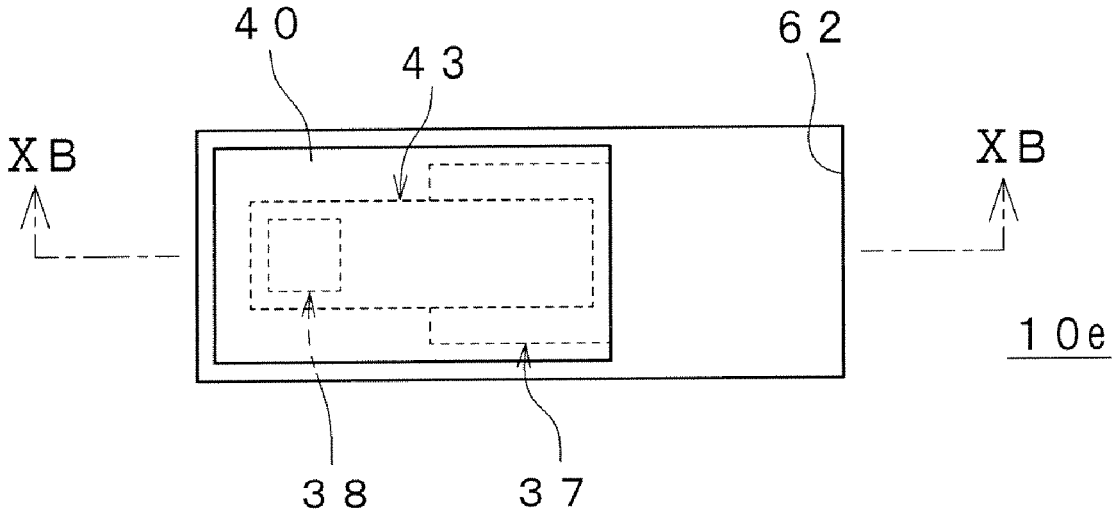
FIG. 10A is a diagram for showing a configuration of a contactless switch according to a still further embodiment of the invention and FIG. 10B is a sectional outline view thereof taken long the lines XB-XB shown in FIG. 10A.
Figure 10B:
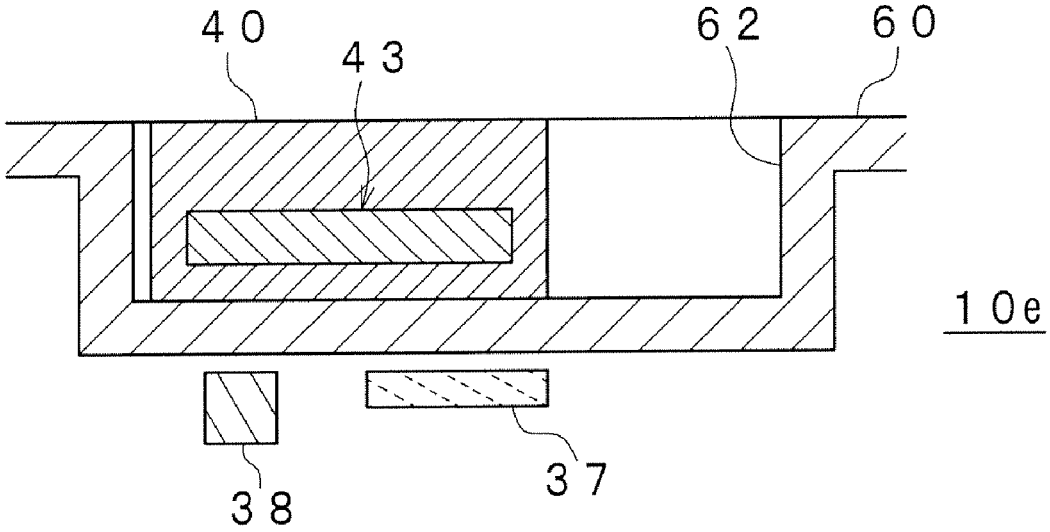

Although such the configuration that the operation portion rotates has been described in the contactless switch according to each of the above embodiments, the invention is not limited thereto. An operation portion can be slid. FIGS. 10A and 10B show a configuration of a contactless switch 10*e* according to a still further embodiment of the invention in which the operation portion 40 can be slid to perform a switching operation. FIG. 10A is a front view of the contactless switch 10*e*. FIG. 10B is a sectional outline view thereof taken long the lines XB-XB shown in FIG. 10A.

The operation portion 40 of the contactless switch 10*e* has a configuration such as a rectangular parallelepiped having a slightly shorter width than that of a rectangular channel 62 formed in the casing 60 and a shorter length than that of the rectangular channel 62. When the operation portion 40 is placed in the rectangular channel 62, the operation portion 40 can be slid in the rectangular channel 62.

The operation portion 40 includes a magnet 43 that prevents the operation portion 40 from being detached from the rectangular channel 62 and allows a switching position of the operation portion 40 to be recognized.

Inside the casing 60, a ferromagnet 37 is provided at a position thereof under an almost center portion of the rectangular channel 62. A magnetic-field-sensing element 38 is provided at a position facing the ferromagnet 37, inside the casing 60, on at least one direction where the operation portion 40 slides.

In this moment, a size of each of the magnet 43 and the ferromagnet 37 and/or strength of the magnet 43 are set so that no weak attracting force occurs between the magnet 43 and the ferromagnet 37, when the operation portion 40 slides, to detach the operation portion 40 from the rectangular channel 62. A size of the magnet 43 is set so that a position of the operation portion 40 can be recognized on the basis of output from the magnetic-field-sensing element 38 when the operation portion 40 slides.

For example, they are set so that when the operation portion 40 slides up to an end of the rectangular channel 62, the magnet 43 faces the ferromagnet 37 and the magnetic-field-sensing element 38 while when the operation portion 40 slides up to the other end of the rectangular channel 62, the magnet 43 faces only the ferromagnet 37 and does not face the magnetic-field-sensing element 38.

Such the contactless switch 10*e* thus configured enables a sensor signal Sa to be output from the magnetic-field-sensing element 38 in response to a switching operation by the user when he or she slides the operation portion 40 to performs the switching operation. Further, according to this embodiment, it is possible to prevent the operation portion 40 from being detached from the rectangular channel 62 if the operation portion 40 slides.

The following will describe an embodiment of a recording medium according to the invention to which the above contactless switches are applicable. Although the above contactless switches can be applied to any of the recording media of contact type and of non-contact type, they are preferably applicable to a recording medium of non-contact type having a sealed structure because the operation portion and the detection portion are separated from each other in the above contactless switches.

Figure 11:
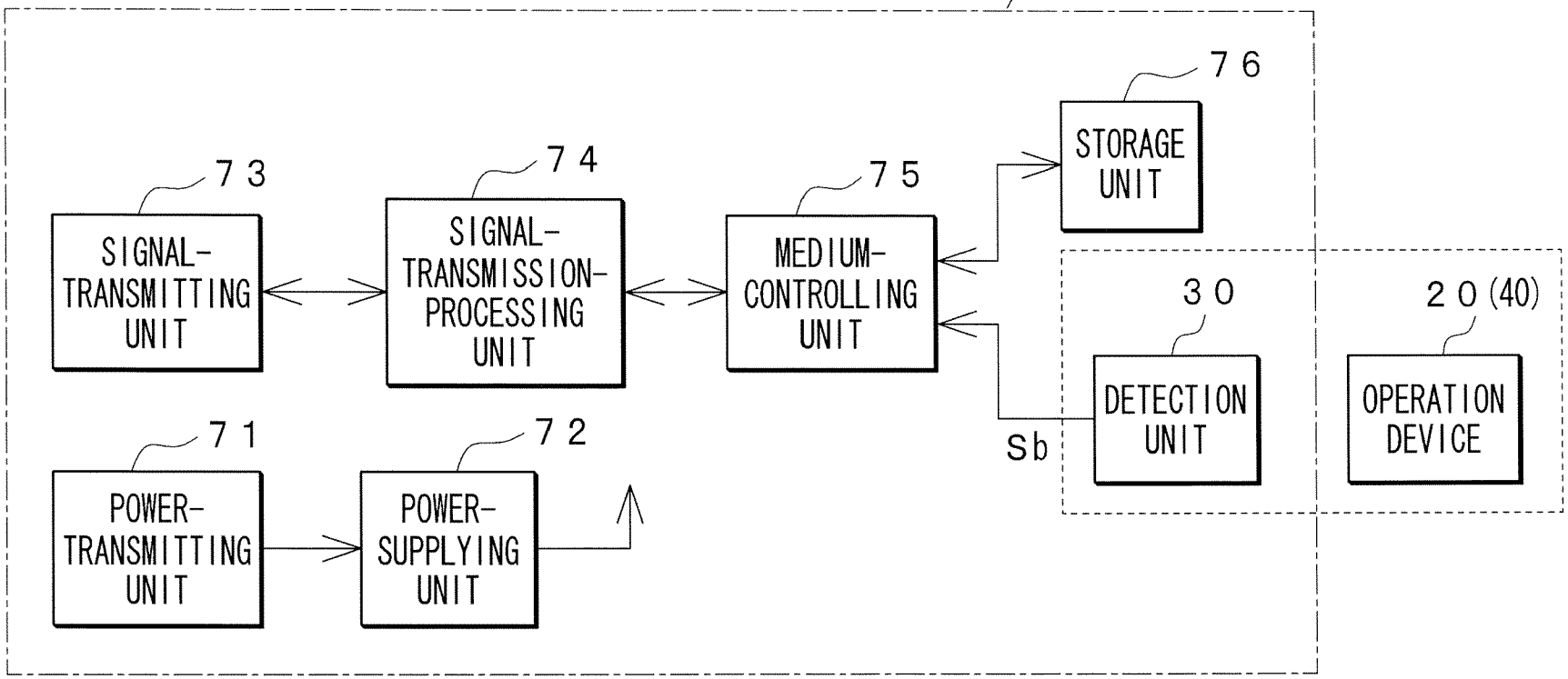
FIG. 11 is a block diagram for showing a recording medium using a contactless switch according to an embodiment of the invention.

FIG. 11 shows a configuration of a recording medium of non-contact type to which the contactless switch is applicable. The recording medium of non-contact type 70 has a power-transmitting unit 71 that performs any non-contact power transmission from a reader/writer, not shown, which reads or writes data from or to the recording medium of non-contact type 70, and a signal-transmitting unit 73 that reads or writes the data by wireless. The signal-transmitting unit 73 transmits the signal in a higher frequency band than that used in the non-contact power transmission to enable the data to be rapidly read or written. For example, the signal-transmitting unit 73 may be configured by an antenna that receives and/or transmits a wireless signal and it transmits a signal in a higher frequency band than that used in the non-contact power transmission. When the recording medium of non-contact type 70 is brought very close to the reader/writer, a signal can be transmitted between the recording medium of non-contact type 70 and the reader/writer using any electromagnetic coupling occurred therebetween. In this case, the signal-transmitting unit 73 may be configured by using a microstrip line. It is to be noted that when it is not necessary for the data to be rapidly read or written, a signal can be transmitted by the power-transmitting unit 71 that is configured by using a coiled antenna in place of the signal-transmitting unit 73.

The power-transmitting unit 71 is connected to a power-supplying unit 72. The power-supplying unit 72 performs any rectification and/or a smoothing on voltage generated at a result of the electromagnetic coupling between the power-transmitting unit 71 and the reader/writer to generate direct current voltage. The power-supplying unit 72 supplies the generated direct current voltage to various parts of the recording medium of non-contact type 70.

The signal-transmitting unit 73 is connected to a signal-transmission-processing unit 74. The signal-transmission-processing unit 74 receives a high frequency signal from the signal-transmitting unit 73 and converts it back to an original signal before it has been processed in a signal-transmission-processing unit of the reader/writer to supply the converted one to a medium-controlling unit 75. The signal-transmission-processing unit 74 also receives a signal from the medium-controlling unit 75 and converts it to a high frequency signal that is used for signal transmission to supply the converted one to the signal-transmitting unit 73. For example, the signal-transmission-processing unit 74 performs any processing to transmit a signal using a carrier wave or without using the carrier wave such as ultra wide band (UWB) transmission.

The medium-controlling unit 75 receives a signal from the signal-transmission-processing unit 74 and determines which instruction the reader/writer gives based on the received signal to perform any processing based on a determination result. For example, if it is determined that the reader/writer gives a writing request, the medium-controlling unit 75 controls the storage unit 76 to store data received from the reader/ writer thereinto. If it is determined that the reader/writer gives a reading request, the medium-controlling unit 75 controls the storage unit 76 to read data out thereof and supplies the read data to the signal-transmission-processing unit 74 as a signal with a predetermined format.

A detection portion 30 of any one of the above contactless switches is connected to the medium-controlling unit 75. The detection portion 30 generates a switching signal Sb indicating a setting condition of the switch by the user and supplies the switching signal Sb to the medium-controlling unit 75. When only one switch position is detected as the above contactless switches 10*a*, 10*e*, the medium-controlling unit 75 controls the storage unit 76 of the recording medium to read or write the data therefrom or thereto based on the switching signal Sb received from the detection portion 30 in response to an operated position of the operation portion 20 (20*a*, 40). Namely, the medium-controlling unit 75 may switch an operation mode as a control of reading or writing the data, among a read-write-forbidden mode in which the data is forbidden from being read or written from or to the storage unit 76, a read-write-allowable mode in which the data is allowed to be read or written from or to the storage unit 76, and a read-only mode in which the data is forbidden from being written to the storage unit 76 and is allowed to be read therefrom.

When three switch positions are detected as the above contactless switches 10*b*, 10*c*, the medium-controlling unit 75 controls the storage unit 76 to switch an operation mode among the read-write-forbidden mode, the read-write-allowable mode and the read-only mode based on the switching signal Sb received from the detection portion 30 in response to an operated position of the operation portion 20.

The power-transmitting unit 71, the power-supplying unit 72, the signal-transmitting unit 73, the signal-transmission-processing unit 74, the medium-controlling unit 75, and the storage unit 76 are enclosed in the sealed casing.

When any one of the above contactless switches is applicable to the recording medium of non-contact type 70 thus configured, it is possible to switch operation modes of the recording medium of non-contact type 70 by operating the operation portion 20 (20*a*, 40) even if the recording medium of non-contact type 70 is enclosed in the sealed casing.

When plural magnetic-field-sensing elements are used therein, it is possible to determine which direction the operation portion rotates. For example, when plural magnetic-field-sensing elements are used therein as the contactless switches 10*b*, 10*c*, it is possible to determine which direction the operation portion 20 rotates. Even when the operation portion 40 is slid as the contactless switch 10*e*, it is possible to determine which direction the operation portion slides because the magnetic-field-sensing element 38 is provided near an end of the rectangular channel. Accordingly, if operation information of the operation portion is utilized as identification information, it is possible to allow the data to be read or written from or into the recording medium of non-contact type 70 only when the operation portion is operated according to any previously indicated method. For example, only if the operation portion 20 rotates clockwise by Na times and counterclockwise by Nb times, it is possible to allow the data to be read or written from or into the recording medium of non-contact type 70. Alternatively, only if the operation portion 40 slides from a center portion of the rectangular recess toward an end thereof by Na times and then toward the other end thereof by Nb times, it is possible to allow the data to be read or written from or into the recording medium of non-contact type 70. This enables the user(s) who can use the recording medium of non-contact type 70 to be limited to one(s) who know(s) this identification information.

Although in the above embodiments, the cases in which the operation portion is attached have been described, if the operation portion is detached, no magnetic field by a magnet provided in the operation portion can be detected by any of one or plural magnetic-field-sensing elements. Accordingly, it is possible to determine based on the switching signal Sb whether the operation portion is attached or detached.

If it is determined on the basis of the switching signal Sb from the detection portion 30 that the operation portion 20 (20*a*, 40) is detached, the medium-controlling unit 75 sets the operation mode to a forbidden mode in which the data is forbidden from being written into the storage unit 76. In this moment, detaching the operation portion 20 (20*a*, 40) prevents the data stored in the storage unit 76 from being rewritten. If the medium-controlling unit 75 sets the operation mode to a forbidden mode in which the data is forbidden from being read from the storage unit 76, detaching the operation portion 20 (20*a*, 40) also prevents the data stored in the storage unit 76 from being read.

It is to be noted that concerning the control of reading or writing the data from or into the storage unit 76, this invention is not limited to the above switching operation of the operation modes. For example, according to an embodiment of the invention, it is possible to perform any control depending on various kinds of data in which only data of a moving or still image can be written.

It should be understood by those skilled in the art that various modifications, combinations, sub-combinations and alternations may occur depending on design requirements and other factors insofar as they are within the scope of the appended claims or the equivalents thereof.

What is claimed is:

1. A switch comprising:

a detection portion that contains a magnetic-field-sensing element and a first attraction member, said first attraction member generating a magnetically attracting force; and an operation portion that contains a magnet, wherein the first attraction member generates a magnetically attracting force between the operation portion and the detection portion; and wherein when the operation portion is operated with the operation portion being attracted by the first attraction member, the detection portion generates a switching signal based on an output of the magnetic-field-sensing element in response to an operation which is applied to the operation portion;

wherein the detection portion generates a switching signal based on an output of the magnetic-field-sensing element;

wherein the operation portion has a disk configuration and is configured to rotatably spin within a recess of the detection portion, and when the operation portion is operated with the operation portion being attracted by the first attraction member, the operation portion rotates on a center of action by the magnetically attracting force as its revolution axis, and wherein the operation portion fits completely within the recess of the detection portion such that a top surface of the operation portion is co-planar with a top surface of the detection portion adjacent the recess.

2. The switch according to claim 1, wherein the detection portion generates the switching signal based on an alteration in a position of the magnet against the magnetic-field-sensing element in response to a rotation operation which is applied to the operation portion.

3. The switch according to claim 1, wherein the detection portion is enclosed in a sealed casing and the operation portion is provided out of the sealed casing.

* * * * *